US007850785B2

(12) United States Patent
Kernick et al.

(10) Patent No.: US 7,850,785 B2
(45) Date of Patent: Dec. 14, 2010

(54) LENS WASH STATION AND METHODS OF ITS USE

(75) Inventors: Edward R. Kernick, Jacksonville, FL (US); Anthony H. Darabi, Ponte Vedra Beach, FL (US); Leslie Voss, Jacksonville, FL (US); Charles Hood, Jacksonville, FL (US)

(73) Assignee: Johnson & Johnson Vision Care, Inc., Jacksonville, FL (US)

( * ) Notice: Subject to any disclaimer, the term of this patent is extended or adjusted under 35 U.S.C. 154(b) by 793 days.

(21) Appl. No.: 11/644,694

(22) Filed: Dec. 22, 2006

(65) Prior Publication Data

US 2007/0163623 A1 Jul. 19, 2007

Related U.S. Application Data

(60) Provisional application No. 60/755,144, filed on Dec. 30, 2005.

(51) Int. Cl.
*B08B 3/02* (2006.01)

(52) U.S. Cl. ..... 134/32; 134/34; 134/137; 134/141; 134/142

(58) Field of Classification Search ..... 134/34, 134/42, 137, 138, 32, 140, 141, 142, 144, 134/145; 53/247, 248, 251
See application file for complete search history.

(56) References Cited

U.S. PATENT DOCUMENTS 4,691,820 A 9/1987 Martinez
5,054,610 A 10/1991 Ajello
5,337,888 A 8/1994 Morrison
5,375,698 A 12/1994 Ewart et al.
5,409,104 A 4/1995 Lovell
5,467,868 A 11/1995 Abrams et al.
5,515,964 A 5/1996 Bauman
5,561,970 A * 10/1996 Edie et al. ..... 53/473
5,573,108 A 11/1996 Hamilton et al.
5,609,246 A 3/1997 Borghorst et al.
5,649,410 A 7/1997 Martin et al.
5,695,049 A 12/1997 Bauman
5,697,495 A 12/1997 Abrams et al.
5,704,468 A 1/1998 Lust et al.
5,711,416 A 1/1998 Bauman
5,722,536 A 3/1998 Pierce et al.
5,823,327 A 10/1998 Wu et al.
5,983,608 A 11/1999 Wu et al.
6,029,808 A 2/2000 Peck et al.
6,044,966 A 4/2000 Haase
6,401,915 B1 6/2002 Faxe

FOREIGN PATENT DOCUMENTS

WO WO-03/089306 * 10/2003
WO WO 03/089306 A1 10/2003

OTHER PUBLICATIONS

PCT International Search Report, dated Jul. 11, 2007, for PCT Int'l. Appln. No. PCT/US2006/048762.

* cited by examiner

*Primary Examiner*—Michael Barr
*Assistant Examiner*—Saeed T Chaudhry

(57) ABSTRACT

An apparatus and method for removing debris from ophthalmic lens transfer tips during the manufacturing or the ophthalmic lenses.

15 Claims, 5 Drawing Sheets

LENS WASH STATION AND METHODS OF ITS USE

RELATED APPLICATIONS

This application is a non-provisional filing of U.S. Pat. App. No. 60/755,144 filed Dec. 30, 2005, entitled Ophthalmic Lens Package and Methods of its Use.

FIELD OF THE INVENTION

The present invention relates to an apparatus and method for manufacturing ophthalmic lenses, particularly an apparatus and method for improving the transfer of ophthalmic lenses during the manufacturing process.

BACKGROUND OF THE INVENTION

Ophthalmic lenses, including contact lenses, intra-ocular lenses and overlay lenses and particularly disposable contact lenses, have been manufactured through highly automated processes. In several processes, either partially polymerized or unpolymerized blends of components are placed between male and female mold parts and subsequently polymerized by either or both light and heat. Thereafter the polymerized lens is removed from the mold, processed in subsequent steps (hydration, removal of unreacted components and the like) and packaged in primary (i.e. blister packages, individual vials, or glass bottles) and secondary packaging (boxes or cartons). During many of the aforementioned steps the ophthalmic lenses are transferred from processing station to processing station using a variety of mechanical fingers, suction cups, tips and the like. One problem with these transfer devices is that they need to be cleaned throughout the manufacturing process to removed adhered lenses and other debris. If the adhered lenses and other debris remain on the transfer tips, that material is often transferred into the primary packaging and the infected product must be discarded. Previously devices to wash transfer tips required that the tips be inserted into washing holes and sprayed with water. Although this method worked, the precision required to line up the transfer tips with the washing holes often resulted in mechanical problems such as damaged tips, jammed machinery and the like. Accordingly, there is a need for an apparatus and method for removing debris transfer tips without incurring these problems. This need is met by the following invention.

DETAILED DESCRIPTION OF THE INVENTION

The invention includes an apparatus for cleaning the tips of ophthalmic lens transfer tips, comprising a wash station and a movable arm wherein the wash station comprises a first wall, a second wall, and a hollow channel connecting the first wall and the second wall wherein the first wall comprises an inner first surface and an outer first surface wherein the inner first surface comprises at least two apertures, each of which extends from the inner first surface through the first wall to the hollow channel wherein the second wall comprises an inner second surface and an outer second surface wherein the inner second surface comprises at least two apertures, each of which extends from the inner second surface through the second wall to the hollow channel, wherein the hollow channel extends from the outer first surface through the inner first surface, the inner second surface terminates at the outer second surface.

wherein the movable arm comprises at least two ophthalmic lens transfer tips.

As used herein, "ophthalmic lens" refer to a device that resides on the eye, including but not limited to soft contact, lenses, hard contact lenses, intraocular lenses, overlay lenses, preferably soft contact lenses. "Transfer tips" refer to devices that are used to move a cured ophthalmic lens from one portion of the manufacturing line to another portion thereof. Examples of transfer tips include but are not limited to suction cups, fingers, mechanical eyeballs and the like. It is preferred that the transfer tips are those used to transfer hydrated soft contact lenses to their primary packaging. Primary packaging may be polymer or glass container that may be hermetically sealed to ensure sterility of ophthalmic lenses. Non-limiting examples of such primary packaging are disclosed in the following US Patents, which are hereby incorporated by reference in their entirety U.S. Pat. Nos. 4,691,820; 5,054,610; 5,337,888; 5,375,698; 5,409,104; 5,467,868; 5,515,964; 5,609,246; 5,695,049; 5,697,495; 5,704,468; 5,711,416; 5,722,536; 5,573,108; 5,823,327; 5,704,468; 5,983,608; 6,029,808; 6,044,966; and 6,401,915.

Figure 1:
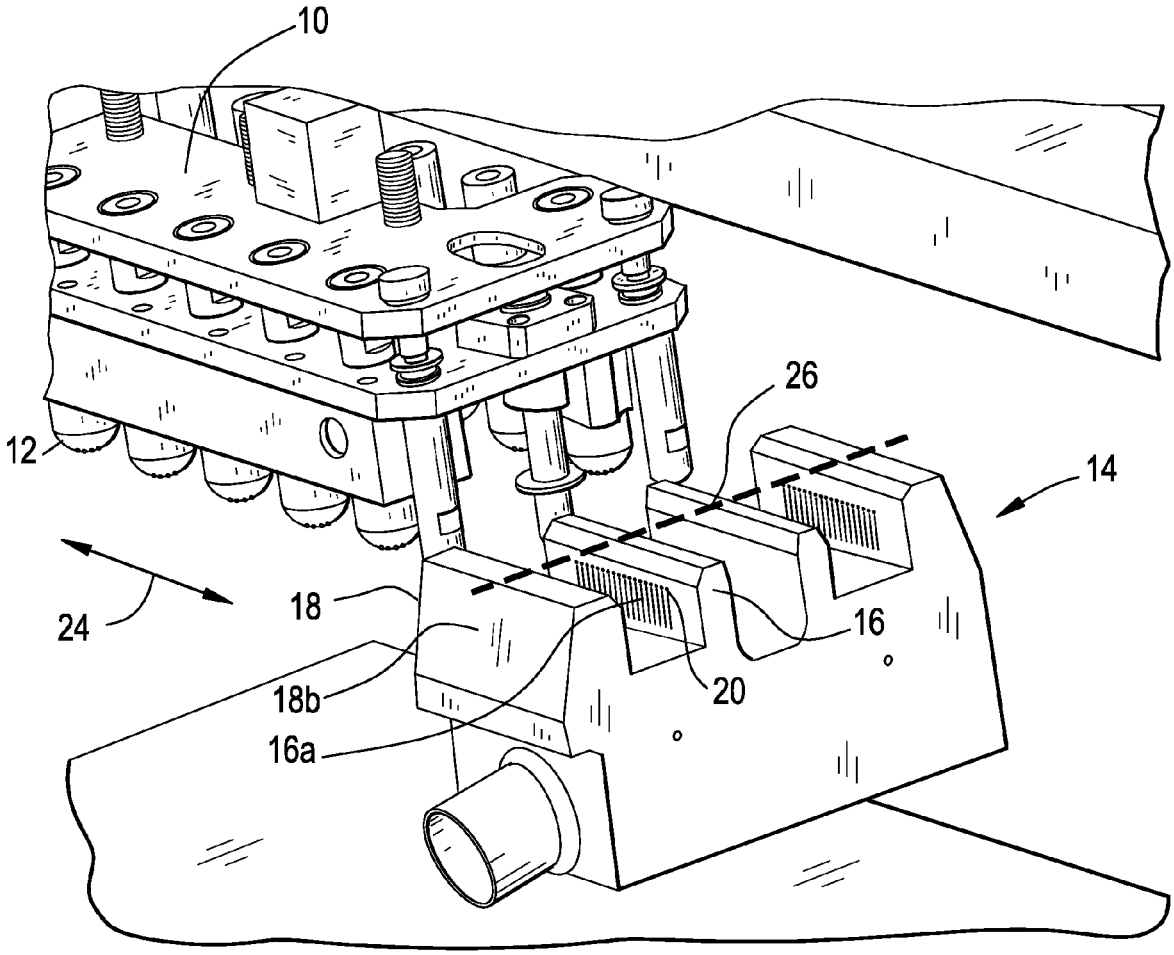
FIG. 1 is a top perspective view of an apparatus of the invention.
Figure 2:
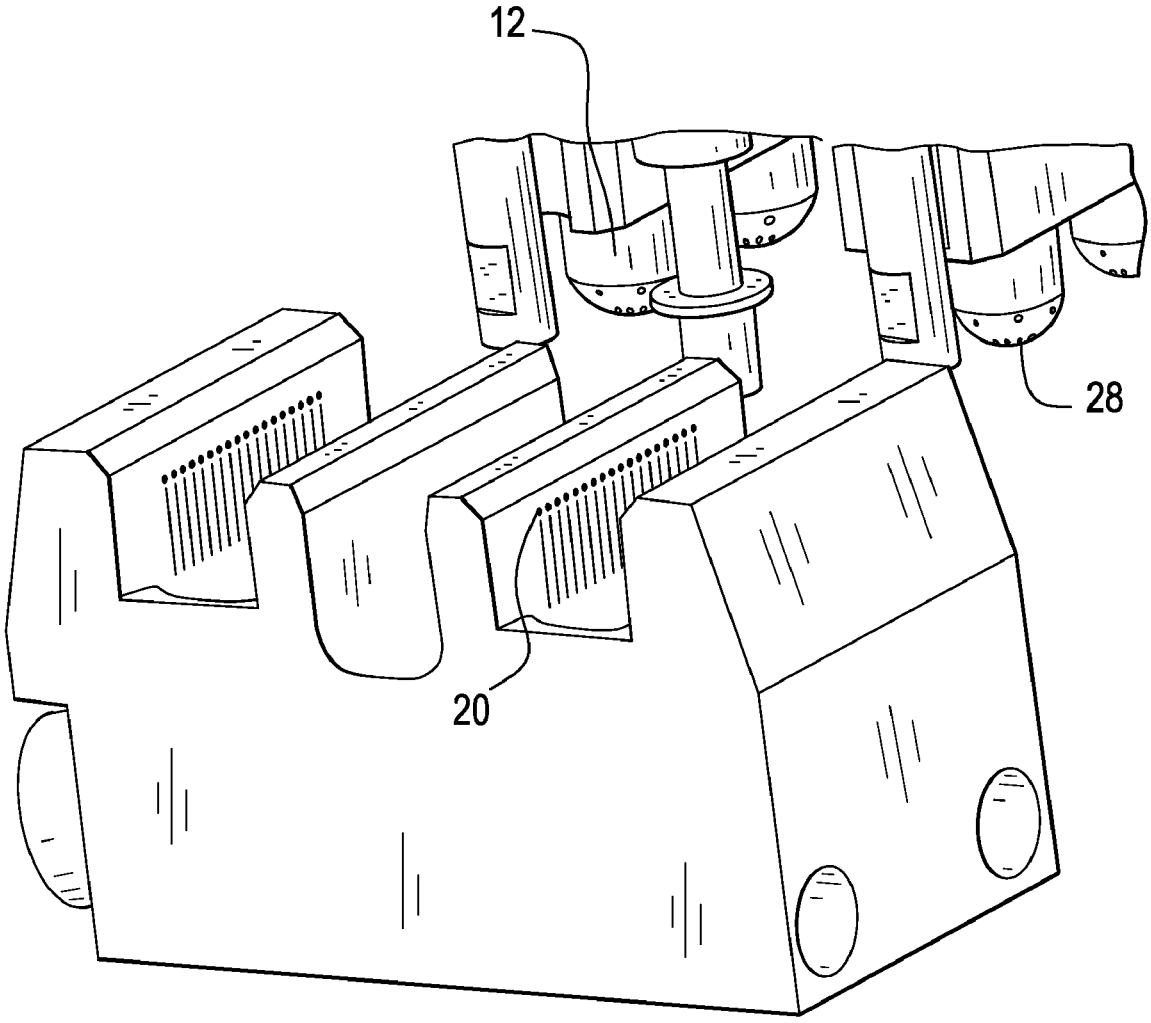
FIG. 2 is a top perspective view of an apparatus of the invention

Referring to FIG. 1 a movable arm 10 includes a number of lens transfer tips 12. Transfer tips 12 are used to transfer molded ophthalmic lenses from hydration cups to primary packaging. For non-limiting examples of hydrations cups see FIG. 5a, item 200 of U.S. Pat. No. 5,649,410, which is hereby incorporated by reference in its entirety. Wash station 14 has first wall 16 and a second wall 18. First wall 16 has inner first surface 16*a* and outer first surface 16*b* (not shown). Second wall 18 has inner second surface 18*a* (not shown) and outer second surface 18*b*. A number of apertures 20 are contained on first surfaces 16*a* and 18*a*. In FIG. 1 dashed line 26 is drawn from the top of first wall 16 to the top of second wall 18 to illustrate the level horizontal axis. It is preferred that the angle of apertures be about 10 to about 30 degrees, more preferably about 15 degrees from horizontal facing towards the hollow channel. Further it is preferred that each for every width of each transfer tip there are about 5 to about 16 apertures. In the depicted apparatus there are 32 apertures on each inner surface. The end 24 of hollow channel 22 extends beyond outer second surface 18*b*. As illustrated in FIG. 2, transfer tips 12 contain a series of apertures located at the rounded tip of each transfer.

For example if the transfer tips of the apparatus are transferring molded ophthalmic lenses between hydration cups and primary packaging, the apparatus removes residual lenses adhered to the lens transfer tips as follows. Pressurized water is directed through hollow chamber 22 to apertures 20 on said inner first surface 16*a* and said inner second surface 18*a*. Movable arm 10 moves transfer tips 12 between said inner first surface 16*a* and said inner second surface 18*a* when the pressurized water exists apertures 20. The movable arm 10 may move the transfer tips between the inner first and inner second walls either horizontally or vertically. It is preferred that the movable arm moves horizontally in both directions as indicated the double arrow 24. The means for moving or passing said at least two ophthalmic lens transfer tips between the inner first surface and the inner second surface may be any of number of mechanical pumps, pulleys or other mechanisms. The water removes residual lenses from the transfer tips. As illustrated in FIG. 2, transfer tips 12 contain a series of apertures located at the rounded tip 28 of each transfer. It is preferred that the pressured water leaving apertures 20 contact the transfer tip at a point about zero to about one inch above rounded tip 28.

The invention includes a method of removing debris from ophthalmic lens transfer tips comprising forcing water through the hollow channel of a wash station comprising a first wall, a second wall, and a hollow channel connecting the first wall and the second wall wherein the first wall comprises an inner first surface and an outer first surface wherein the inner first surface comprises at least two apertures, each of which extends from the inner first surface through the first wall to the hollow channel wherein the second wall comprises an inner second surface and an outer second surface wherein the inner second surface comprises at least two apertures, each of which extends from the inner second surface through the second wall to the hollow channel, wherein the hollow channel extends from the outer first surface through the inner first surface, the inner second surface terminates at the outer second surface, and moving the lens transfer tips between the first inner surface and the second inner surface.

The terms ophthalmic lens, and transfer tips retain their aforementioned meaning. The preferred number of apertures 20 and their preferred physical description is as above. The term "moving" refers to any movement of the transfer tips between the inner first surface and the inner second surface. It is preferred that the transfer tips are moved horizontally.

The invention further includes an apparatus for cleaning the tips of ophthalmic lens transfer tips, comprising a movable arm and a wash station comprising a first wall and a second wall wherein the first wall comprises an inner first surface and an outer first surface wherein the inner first surface comprises at least two apertures, each of which extends from the inner first surface through the first wall to a first wall port wherein the second wall comprises an inner second surface and an outer second surface wherein the inner second surface comprises at least two apertures, each of which extends from the inner second surface through the second wall to a second wall port, wherein the movable arm comprises at least two ophthalmic lens transfer tips.

Figure 3:
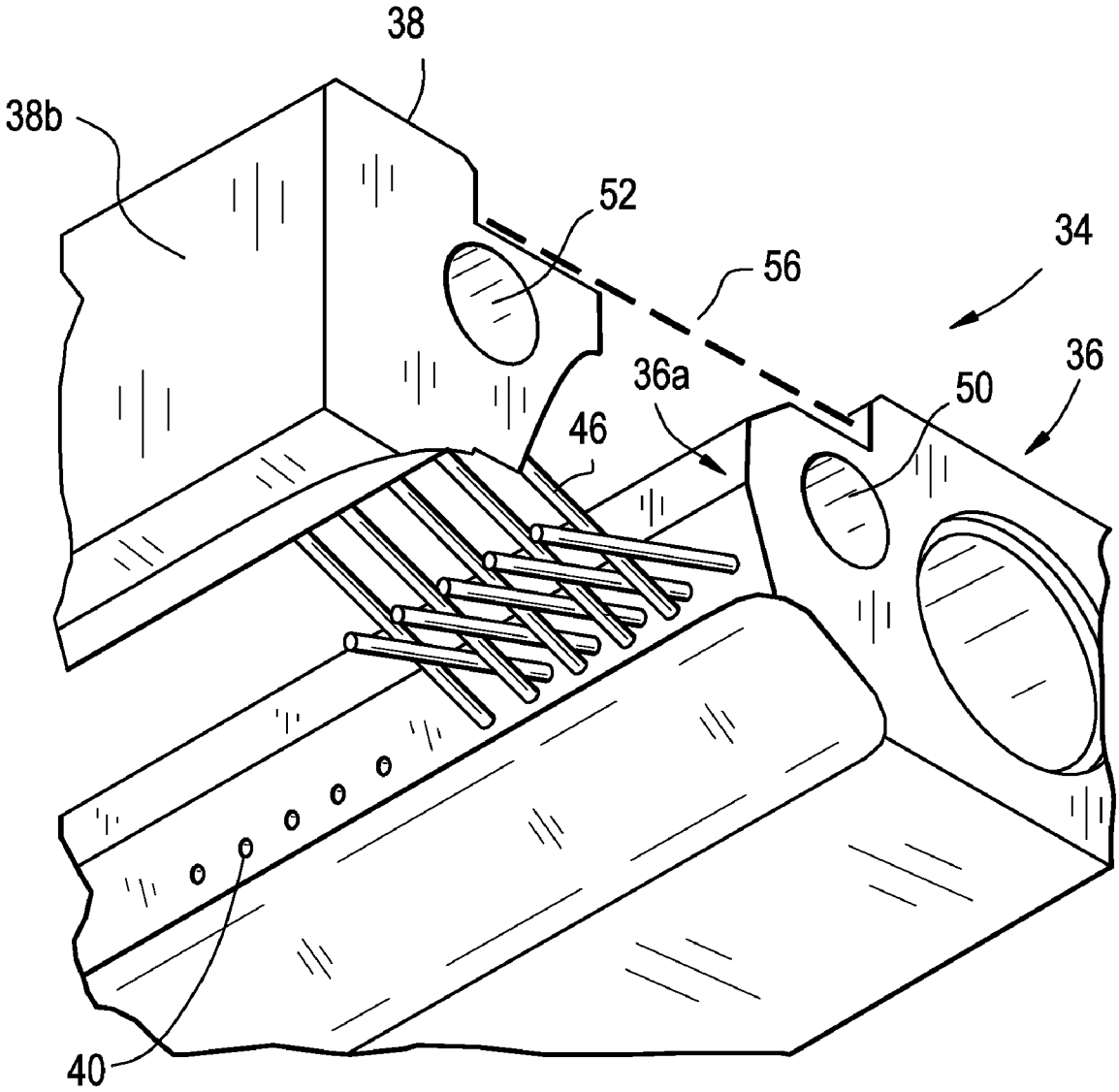
FIG. 3 is a bottom perspective view of a portion of an apparatus of the invention
Figure 4:
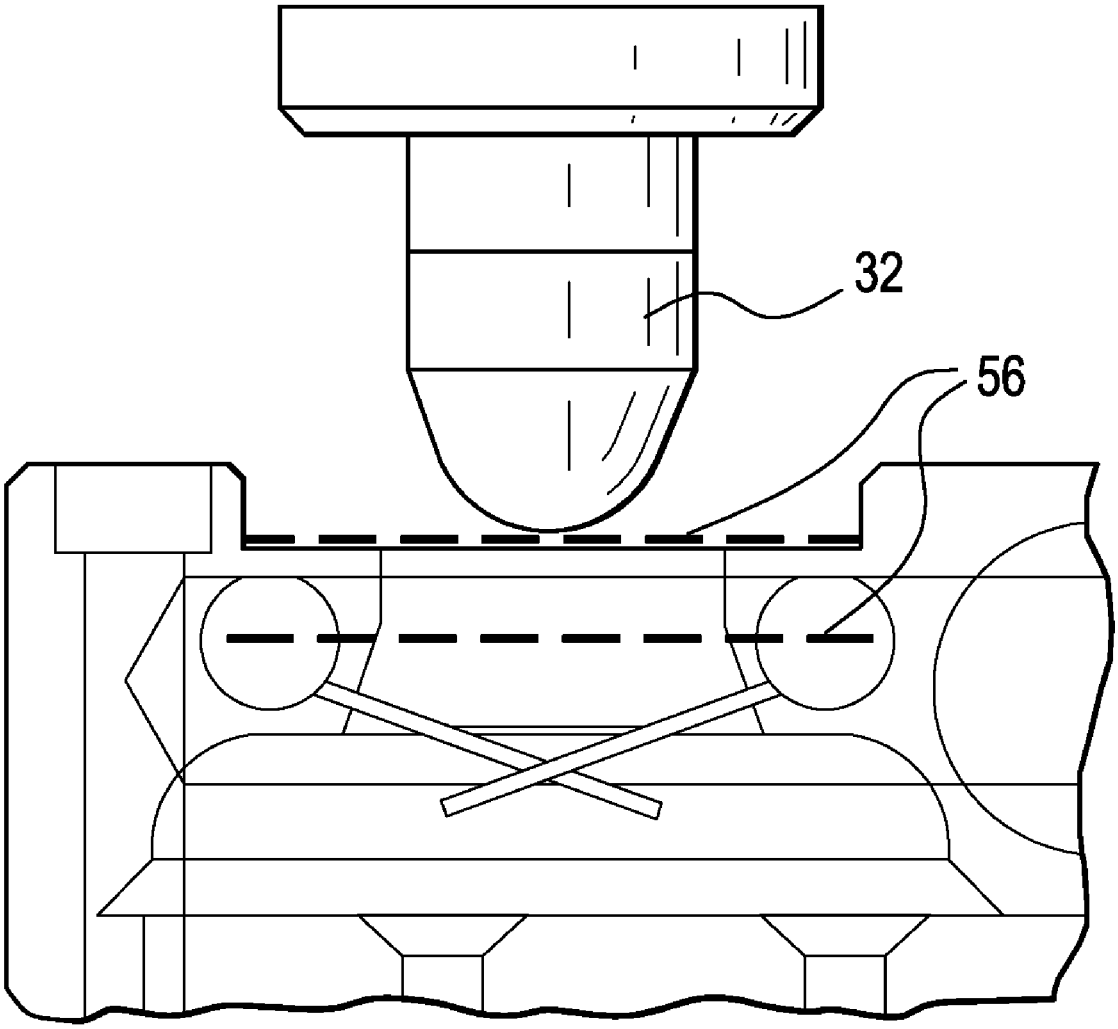
FIG. 4 is a cross sectional cutaway of a front plan view of an apparatus of the invention
Figure 5:
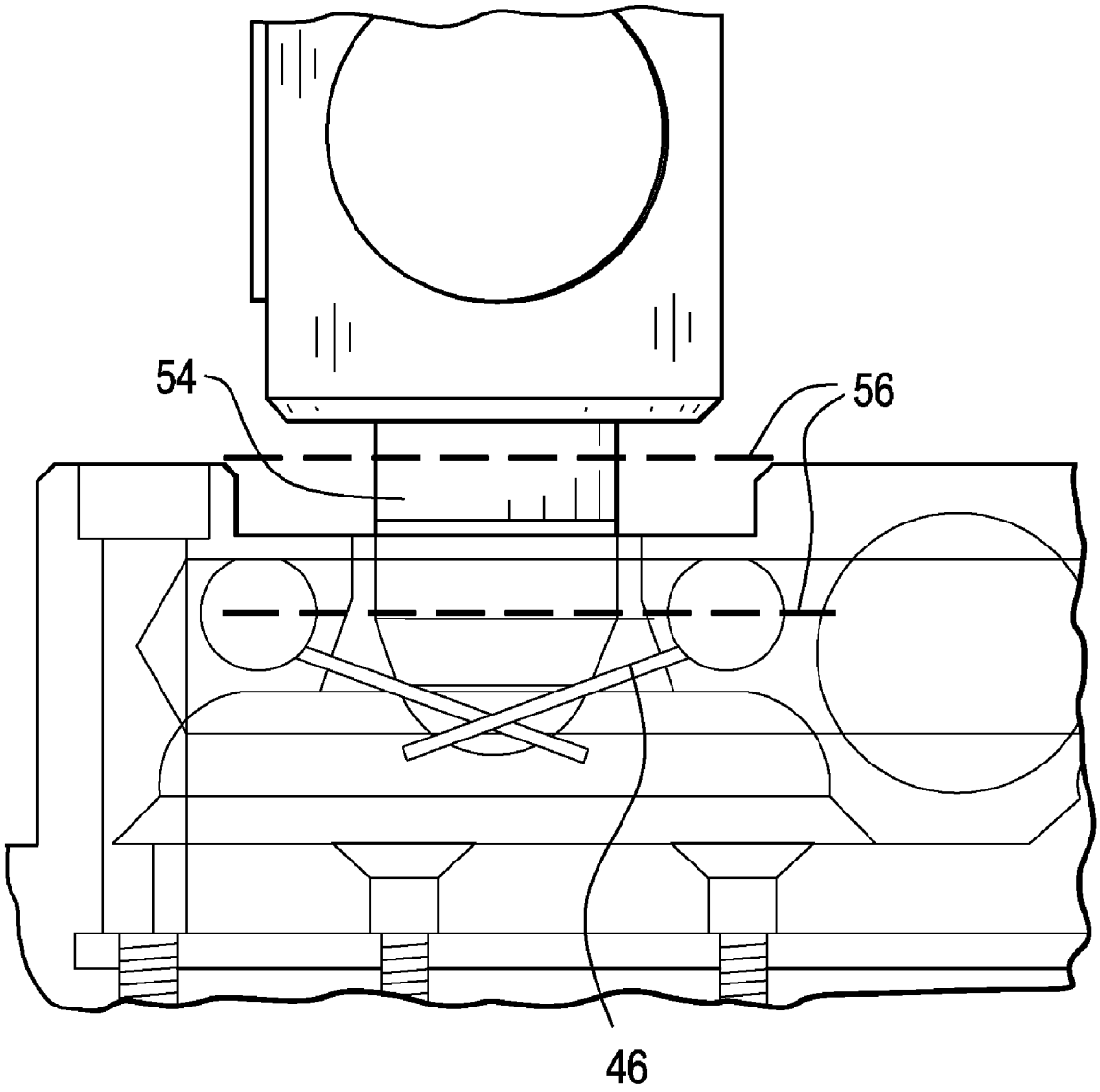
FIG. 5 is a cross sectional cutaway of a front plan view of an apparatus of the invention

The terms ophthalmic lens, and transfer tips retain their aforementioned meaning. The preferred number of apertures 20 and their preferred physical description is as above. FIGS. 3, 4, and 5 illustrate an embodiment of the invention FIGS. 3 and 4 illustrates wash station 34 having first wall 36 and a second wall 38. First wall 36 has inner first surface 36*a* and outer first surface 36*b* (not shown). Second wall 38 has inner second surface 38*a* (not shown) and outer second surface 38*b*. A number of apertures 40 are contained on first inner surfaces 36*a* and 38*a*. A first wall port 50 and a second wall port 52 extend through to apertures 40. Each of wall port 50 and 52 may be connected to source of water. Dark lines 46 represent water being forced through the wall ports to the apertures. It is preferred that the angle of apertures 40 be about 10 to about 30 degrees, more preferably about 15 degrees from horizontal axis, represented by the dashed line 56, facing away from the transfer tip 32. Further it is preferred that each for every width of each transfer tip there are about 5 to about 16 apertures. In the depicted apparatus there are 32 apertures on each inner surface. FIG. 5 illustrates a transfer tip 54 that is moved vertically from its position in FIG. 4 between inner first surface 36*a* and inner second surface 38*a*

The invention includes a method of removing debris from ophthalmic lens transfer tips comprising forcing water through the wall ports of a wash station comprising a first wall and a second wall wherein the first wall comprises an inner first surface and an outer first surface wherein the inner first surface comprises at least two apertures, each of which extends from the inner first surface through the first wall to a first wall port wherein the second wall comprises an inner second surface and an outer second surface wherein the inner second surface comprises at least two apertures, each of which extends from the inner second surface through the second wall to a second wall port, moving the ophthalmic lens transfer tips between the inner first surface and the inner second surface.

All terms used in this invention have their aforementioned meanings and preferred ranges.

It will be understood that the embodiments described herein is merely exemplary and that a person skilled in the art may make many variations and modifications without departing from the spirit and scope of the invention. All such variations and modifications are intended to be included within the scope of the invention as defined in the appended claims.

What is claimed is:

1. An apparatus for cleaning the tips of ophthalmic lens transfer tips, comprising a wash station and a movable arm wherein the wash station comprises a first wall, a second wall, and a hollow channel connecting the first wall and the second wall wherein the first wall comprises an inner first surface and an outer first surface wherein the inner first surface comprises at least two apertures, each of which extends from the inner first surface through the first wall to the hollow channel wherein the second wall comprises an inner second surface and an outer second surface wherein the inner second surface comprises at least two apertures, each of which extends from the inner second surface through the second wall to the hollow channel, wherein the hollow channel extends from the outer first surface through the inner first surface, the inner second surface terminates at the outer second surface wherein the movable arm comprises at least two ophthalmic lens transfer tips and wherein said movable arm moves along a horizontal axis and said movable arm comprises a means for passing said at least two ophthalmic lens transfer tips between the inner first surface and the inner second surface.

2. The apparatus of claim 1, comprising at least about 10 apertures on the inner first surface and at least about 10 apertures on the inner second surface.

3. The apparatus of claim 2, wherein the angle of the apertures is about 10 to about 30 degrees away from the horizontal axis towards the hollow channel.

4. The apparatus of claim 1 wherein for every width of each transfer tip there are about 5 to about 16 apertures.

5. A method of removing debris from ophthalmic lens transfer tips comprising forcing water through the hollow channel of a wash station comprising a first wall, a second wall, and a hollow channel connecting the first wall and the second wall wherein the first wall comprises an inner first surface and an outer first surface wherein the inner first surface comprises at least two apertures, each of which extends from the inner first surface through the first wall to the hollow channel wherein the second wall comprises an inner second surface and an outer second surface wherein the inner second surface comprises at least two apertures, each of which extends from the inner second surface through the second wall to the hollow channel, wherein the hollow channel extends from the outer first surface through the inner first surface, the inner second surface terminates at the outer second surface, and moving the lens transfer tips between the first inner surface and the second inner surface, wherein the lens transfer tips move along the horizontal axis between said first inner surface and the second inner surface.

6. The method of claim 5, wherein the inner first surface comprises at least about 10 apertures and the inner second surface comprises at least about 10 apertures.

7. The method of claim 5, wherein the angle of the apertures is about 10 to about 30 degrees away from the horizontal axis.

8. An apparatus for cleaning the tips of ophthalmic lens transfer tips, comprising a movable arm and a wash station comprising a first wall and a second wall wherein the first wall comprises an inner first surface and an outer first surface wherein the inner first surface comprises at least two apertures, each of which extends from the inner first surface through the first wall to a first wall port wherein the second wall comprises an inner second surface and an outer second surface wherein the inner second surface comprises at least two apertures, each of which extends from the inner second surface through the second wall to a second wall port, wherein the movable arm comprises at least two ophthalmic lens transfer tips and a means for passing said at least two ophthalmic lens transfer tips between the inner first surface and the inner second surface, wherein said means for passing moves said at least two ophthalmic lens transfer tips along the horizontal axis.

9. The apparatus of claim 8, comprising at least about 10 apertures on the inner first surface and at least about 10 apertures on the inner second surface.

10. The apparatus of claim 8, wherein the angle of the apertures is about 10 to about 30 degrees away from the horizontal axis.

11. The apparatus of claim 8 wherein for every width of each transfer tip there are about 5 to about 16 apertures.

12. A method of removing debris from ophthalmic lens transfer tips comprising forcing water through the wall ports of a wash station comprising a first wall and a second wall wherein the first wall comprises an inner first surface and an outer first surface wherein the inner first surface comprises at least two apertures, each of which extends from the inner first surface through the first wall to a first wall port wherein the second wall comprises an inner second surface and an outer second surface wherein the inner second surface comprises at least two apertures, each of which extends from the inner second surface through the second wall to a second wall port, moving the ophthalmic lens transfer tips between the inner first surface and the inner second surface wherein moving comprises movement along the horizontal axis.

13. The method of claim 12, wherein the inner first surface comprises at least about 10 apertures and the inner second surface comprises at least about 10 apertures.

14. The method of claim 12, wherein the angle of the apertures is about 10 to about 30 degrees away from the horizontal axis.

15. The method of claim 12 wherein for every width of each transfer tip there are about 5 to about 16 apertures.

* * * * *